US007900879B2

(12) United States Patent
Carmes

(10) Patent No.: US 7,900,879 B2
(45) Date of Patent: Mar. 8, 2011

(54) SWITCH POINTS MANEUVERING DEVICE WITH MANUAL CONTROL

(75) Inventor: Francis Carmes, Voisins-le-Bretonneux (FR)

(73) Assignee: Alstom Transport SA, Levallois-Perret (FR)

( * ) Notice: Subject to any disclaimer, the term of this patent is extended or adjusted under 35 U.S.C. 154(b) by 707 days.

(21) Appl. No.: 11/879,359

(22) Filed: Jul. 17, 2007

(65) Prior Publication Data

US 2008/0048070 A1 Feb. 28, 2008

(30) Foreign Application Priority Data

Jul. 19, 2006 (FR) ..... 06 06587

(51) Int. Cl.
*B61L 5/00* (2006.01)

(52) U.S. Cl. ..... 246/404; 246/406

(58) Field of Classification Search ..... 246/393, 246/395, 404, 405, 406, 412
See application file for complete search history.

(56) References Cited

U.S. PATENT DOCUMENTS

| | | | | |
|---|---|---|---|---|
| 2,373,517 A | | 4/1945 | Temple | |
| 3,652,849 A | * | 3/1972 | Kleppick | 246/393 |
| 4,824,054 A | * | 4/1989 | Kohake et al. | 246/406 |
| 5,014,937 A | * | 5/1991 | Peters | 246/406 |
| 5,531,408 A | * | 7/1996 | Wechselberger | 246/257 |
| 5,642,870 A | | 7/1997 | Sargis | |

FOREIGN PATENT DOCUMENTS

WO WO 00/20687 A 4/2000

* cited by examiner

*Primary Examiner* — S. Joseph Morano
*Assistant Examiner* — Robert J McCarry, Jr.
(74) *Attorney, Agent, or Firm* — Davidson, Davidson & Kappel, LLC

(57) ABSTRACT

A device is provided for manually maneuvering a set of switch points, the device includes a housing which is intended to apply a force at a location of a set of rail switch points in order to move the set of switch points relative to the housing from a first switch points position to a second switch points position. The device also includes a guided member for controlling the set of switch points, which can be moved relative to the housing, a guiding member, which can also be moved relative to the housing, a transmission mechanism for driving the guided member in one direction when the guiding member moves in a first direction. The guiding member is capable of being moved in a second direction, opposed to the first direction, while the guided member remains fixed relative to the housing.

12 Claims, 6 Drawing Sheets

SWITCH POINTS MANEUVERING DEVICE WITH MANUAL CONTROL

This claims the benefit of French Patent Application No. 06 06587, filed on Jul. 19, 2006 and hereby incorporated by reference herein.

TECHNICAL FIELD

The present invention relates to a device for manually activating a set of switch points.

BACKGROUND TO THE INVENTION

A device of this type is used in particular to move the switch points rail of a set of switch points. To this end, a rod assembly which is formed by an assembly of sliding rods which are connected to each other is arranged along the set of switch points, and the switch points rail is connected to this rod assembly at several locations over the length thereof. At one end, the rod assembly is connected to an activation device which allows the movement of all the rods.

An activation device of this type comprises, as known per se, a housing in which there is arranged an electric drive motor at the output of which a step-down gear is provided. The step-down gear is formed by a train of pinions which are contained in a metal casing. The rotating pinions are each retained on parallel shafts which are carried by two opposing and parallel lateral walls of the casing.

An upstream end of the output shaft of the step-down gear is coupled in terms of rotation by means of an angle gear to a shaft for manually activating the device which is activated by means of a lever. This lever is used in the event of a malfunction of the motor.

Conventionally, the manual maneuvering of switch points driving mechanisms, carried out by means of the lever, ensures complete maneuvering in little more than half a turn.

A device of this type allowed switch points devices to be maneuvered for which the force for guided maneuvering was up to approximately 400 kg, corresponding to a guiding force of 33 kg on the lever.

SUMMARY OF THE INVENTION

New switch points systems which are referred to as "maintenance-free" today require maneuvering forces for the guided member in the order of from 600 kg to 700 kg, which corresponds to a force on the lever which is practically impossible for a single person to apply since it is greater than 50 kg.

The technical problem is to reduce the manual guiding force to be applied to the lever during the operation for maneuvering the set of switch points, while allowing the set of switch points to be completely maneuvered.

An object of the invention is to provide a device for activation using a lever which allows both a force which is acceptable to a normal human being and complete maneuvering of the set of switch points.

The present invention provides a device for manually maneuvering a set of rail switch points which is intended to apply a force at a location of the set of switch points in order to switch the set of switch points from a first position to a second position, the device comprising: a housing, a guided member for controlling the set of switch points, which can be moved relative to the housing, a guiding member, which can be moved relative to the housing, a mechanism for transmitting force from the guiding member to the guided member, wherein the transmission mechanism is such that, when the guiding member is moved along at least two displacement paths which have a common portion for driving the guided member, the guided member is driven on each path of the guiding member in the same direction along successive portions of its own movement path.

According to specific embodiments, the manual maneuvering device may include one or more of the following features:

the transmission mechanism is arranged in such a manner that the guiding member is capable of being moved in a first direction in order to drive the guided member in one direction and is capable of being moved in a second direction, opposed to the first direction, while the guided member remains fixed relative to the housing;

the transmission mechanism includes a movable connection member which allows releasable coupling by matching the shape of the guiding member to the guided member;

the connection member is a member which is selected from the group including a key and an engagement tooth;

the guiding member is a lever which is articulated to the housing, and the transmission mechanism includes, on the one hand, an input shaft which is connected to the guided member and which is capable of being activated by the lever and, on the other hand, a connection member which is capable of coupling or uncoupling the lever to or from the input shaft;

the input shaft is provided at one end with at least two longitudinal and circumferential apertures which are distributed angularly in a uniform manner, and the connection member includes a sliding bolt which is accommodated in the lever and a return spring which is capable of projecting a zone of the sliding bolt outside the lever towards the input shaft, which sliding bolt can be moved between a disengaged position in which the sliding bolt and the apertures are offset at the circumference, and the lever is capable of pivoting freely about the input shaft, and an engaged position in which the sliding bolt is engaged in an aperture and retained therein under the action of the return spring and the lever is locked and fixedly joined to the input shaft;

the sliding bolt includes a pulling member which forms a gripping member for manual activation and which protrudes relative to the lever, allowing the sliding bolt to be moved outside the apertures;

the transmission mechanism further includes a step-down gear and the transmission ratio is less than 1;

the length of the lever arm may be less than 1 meter;

the transmission mechanism includes an angle gear device;

the device includes a device for visualizing the position of the input shaft or correspondingly the set of switch points;

the input shaft includes a position encoding plate which is mounted so as to be fixedly joined to and co-axial with the input shaft, perforated by at least two holes which are positioned with circumferential distribution, and the visualization device includes a sheath, a signaling sensor which includes a rod which is provided at one end with a head which is capable of sliding in the sheath and which has a shape which matches that of the holes, the rod carrying, at a second free end, a visual marker, and a spring for urging the rod of the sensor towards the plate, the spring being pretensioned in the sheath and pressing on the head in order to hold it in contact with a face of the encoding plate when the head is angularly offset from all the holes, the visual marker then leaving the hole of the sheath.

The invention also provides a method for using the switch points maneuvering device according to the invention, wherein the method involves carrying out, at least once, the steps involving:

verifying the initial position of a guiding member between a first guiding member position and a second guiding member position, and the coupled/uncoupled state of the connection for coupling the guiding member to the guided member, carrying out a maneuver in a first direction of the guiding member from the first guiding member position to the second guiding member position, uncoupling the connection member in order to disengage the guiding member from the guided member, carrying out a maneuver in a second direction, opposed to the first direction of the unlocked guiding member, from the second guiding member position to the first guiding member position, coupling the connection member in order to fixedly join the guiding member to the guided member.

According to a specific embodiment, the method may involve carrying out the steps indicated twice in order to move the point to the second position thereof.

The present invention also provides track equipment including a set of switch points and a maneuvering device according to the invention for controlling the set of switch points.

BRIEF DESCRIPTION OF THE DRAWINGS

The invention will be better understood from a reading of the following description of the embodiment, given purely by way of example and with reference to the drawings, in which.

DESCRIPTION OF PREFERRED EMBODIMENTS

Figure 1:
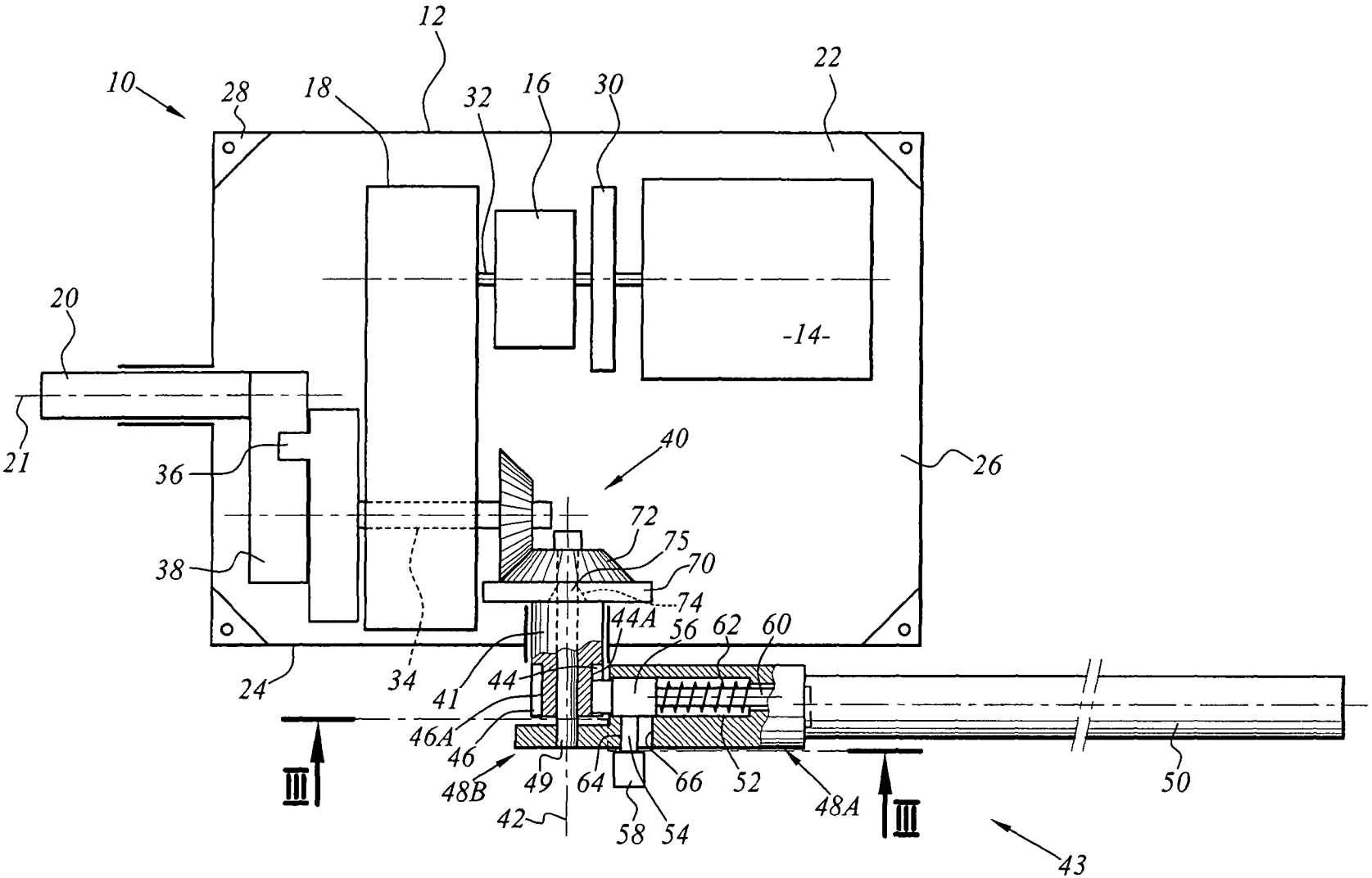
FIG. 1 is a schematic plan view of a device for activating a set of switch points according to the invention with an open cover and an engaged fixing sliding bolt.
Figure 2:
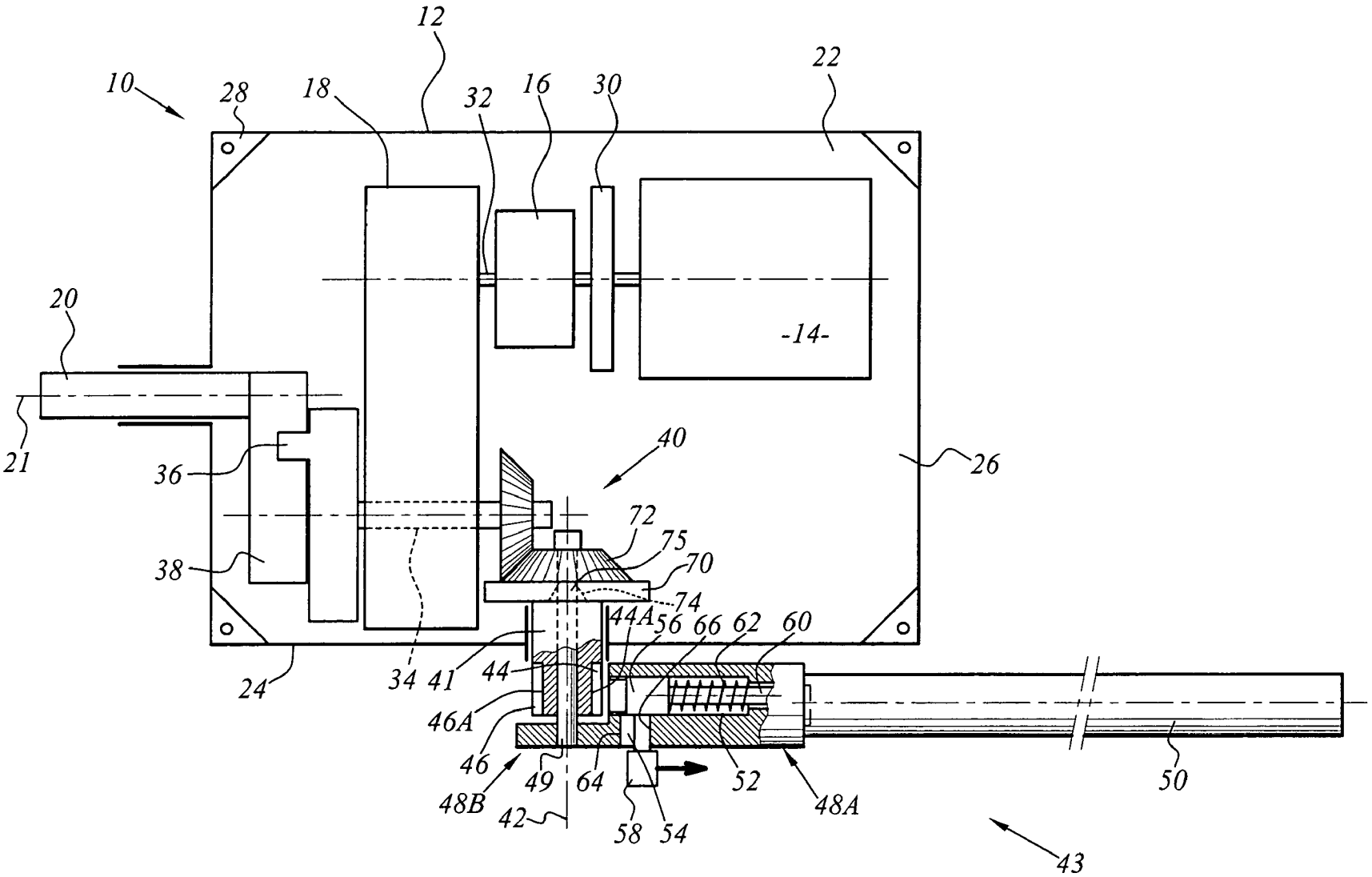
FIG. 2 is a view identical to that of FIG. 1 with the sliding bolt disengaged from the input shaft of the gear mechanism.

As illustrated in FIGS. 1 and 2, a device for activating a set of switch points 10 includes a housing 12 in which there are arranged a motor 14, a torque limiter 16 and a step-down gear 18 whose output is coupled to a guided member 20, in this case a rotating output shaft which is carried by the housing 12 and which extends therethrough.

The housing 12 may be produced, for example, from cast iron by means of casting. The housing 12 includes a base 22 which is bordered by a peripheral wall 24 which delimits, opposite the base, an opening 26 which is normally blocked by a removable cover. This cover extends substantially parallel with the base 22.

Fixing lugs 28 are provided at the periphery of the base 22 in order to fixedly join the activation device on the support thereof to the track.

The motor 14 is arranged in the housing at the side opposite that from which the output shaft 20 emerges. The output of the motor 14 is connected to the torque limiter 16 by means of a driving "star" 30. Advantageously, this torque limiter 16 may be, for example, a magnetic limiter.

The output of the torque limiter 16 is coupled in terms of rotation to a hollow input shaft 32 of the step-down gear. The output shaft designated 34 of the step-down gear includes at one end an eccentric pin 36 which forms a crank which is engaged in a groove of an arm 38 which is fixedly joined transversely to the output shaft 20 of the activation device.

Furthermore, the other end of the output shaft 34 is coupled in terms of rotation by an angle gear 40 to a manual activation or input shaft 41 of the device, which is capable of pivoting about an axis 42. The shaft 41 is carried by the peripheral wall 24 of the housing and protrudes outwards where it has a profile which is capable of receiving a removable transverse control bar which forms a guiding member 43, in this instance a lever, for example, which also forms part of the switch points activation device 10.

The transmission ratio manual activation shaft 41/output shaft 20 may be less than or equal to 1:2, in this instance equal to 1:6, for example.

The length of the lever 43 may be equal to approximately 1 meter, this length corresponding to the best ergonomic positioning for the hands of an operator who is manually maneuvering the switch points device, in particular when the lever is located in a vertical position.

The manual activation shaft 41 includes a first and a second longitudinal aperture 44 and 46, respectively, which are diametrically opposed and recessed on the circumferential periphery at one end of the shaft 41 opposite the angle gear 40.

Figure 3:
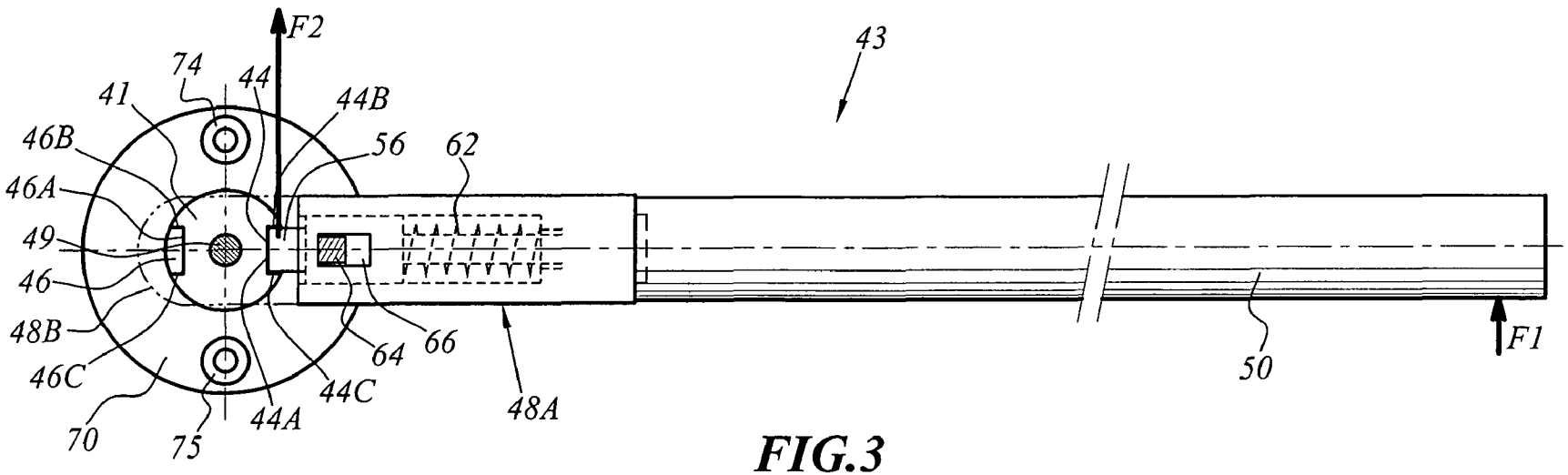
FIG. 3 is a detailed lateral front view of a partial section, taken along the plane III-III, of the manual portion of the activation device corresponding to FIG. 1, with the sliding bolt engaged.
Figure 4:
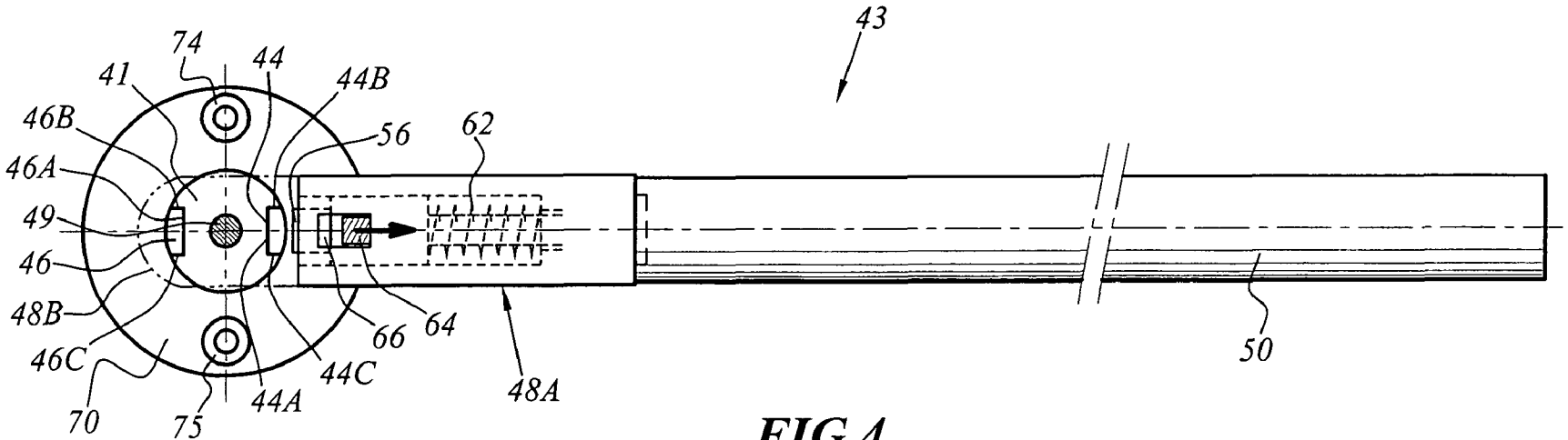
FIG. 4 is a view identical to that of FIG. 3 corresponding to FIGS. 1 and 2 with the sliding bolt disengaged from the input shaft of the gear mechanism.

The first and second apertures 44, 46 are provided, respectively, with a base wall 44A, 46A of a first key coupling zone 44B, 46B and a second key coupling zone 44C, 46C opposite the first, the coupling zones 44B, 46B, 44C, 46C shown in FIGS. 3 and 4.

In a variant, the manual activation shaft may include an assembly of n longitudinal apertures, with n being greater than or equal to 3, uniformly distributed in an angular manner and being recessed on the circumferential periphery at one end of the shaft 41 opposite the angle gear 40.

There is articulated to the manual activation shaft 41 the lever 43 which includes a head 48 which is provided with a hub 49 and a sleeve 50 which extends from the head 48 and which is fixed thereto.

The head 48 includes, in one piece, a solid block 48A, which is generally in the form of a parallelepiped, and a plate 48B which has an oblong shape and which extends one face of the solid block 48.

The partially extended face of the solid block 48A has, on the free portion thereof, a partially cylindrical form which matches one portion of the circumferential surface of the shaft 41 in order to be able to rotate in a skimming manner about the shaft 41.

The oblong plate 48B, on the face thereof directed perpendicularly towards the free portion of the extended face of the solid block 48A, includes, in one piece, a hub 49 which protrudes perpendicularly and which is intended to extend longitudinally through the activation shaft 41 along the axis 42.

The free portion of the extended face of the solid block 48A is perforated along the axis for fitting the sleeve 50 to the head 48 via a first blind hole which forms a chamber 52. The chamber 52 has a support shoulder which is intended to receive a spring and which is formed by a change in the cross-section of the chamber 52.

The solid block 48A, on a parallel face opposite the face at which the head hub 49 emerges, is perforated, recessed relative to the level of the connection face, by a second blind hole for connection to the chamber 52, forming a control chamber 54.

The lever 43 also includes a sliding bolt 56 which is capable of sliding without rotation about the sliding axis inside the sliding bolt chamber 52, a control pulling member 58 which is capable of extending through the control chamber 54 and being fixed to the sliding bolt 56.

In this instance, the sliding bolt is, for example, a removable key.

In a variant, the sliding bolt may be a male element corresponding to an aperture of the engagement tooth type.

The lever 43 also includes a sliding rod 60 which is capable of sliding inside the portion of the chamber 52 having the smallest cross-section. A first return spring 62, of a sliding bolt, which surrounds the rod 60, has a diameter which allows it to be supported on the shoulder of the chamber 52.

When the sliding bolt 56 is mounted in the sliding bolt chamber 52, the sliding bolt presses on the first return spring 62 which is compressed. The complete removal of the sliding bolt 56 from the sliding bolt chamber 52 is prevented by the pulling member 58 which extends through the control chamber 54 and allows the path of the sliding bolt to be limited by a first engagement stop 64. A second disengagement stop 66 opposite the first engagement stop 64 formed by a wall portion of the control chamber 52, allows the path of the pulling member 58 to be limited, and therefore that of the sliding bolt 56 towards the sleeve 50.

The portion of the sliding bolt 56 that is capable of moving out of the sliding bolt chamber 52 includes a surface which matches the surface of each aperture 44, 46.

When the lever head 48 is assembled on the manual activation shaft 41 and the sliding bolt 56 has returned completely inside the chamber 52, the head hub 49 extends through the shaft 41 and is locked in a longitudinal position by a mechanism so that the outer portion for coupling the sliding bolt 56 to the shaft 41 is aligned with the longitudinal centre of the apertures 44, 46.

In FIGS. 1 and 2, a position encoding plate 70 of the control shaft 41 is illustrated, mounted coaxially on the input pinion 72 of the gear device 40. A first recess 74 and a second recess 75 of conical form are perforated at the lever side and are arranged radially in an opposing manner on the encoding plate 70.

FIGS. 3 and 4 illustrate in a detailed manner, along a partial section III-III which can be seen in FIG. 1, the lever 48 which is mounted on the control shaft 41 and in particular zones 44B, 44C, 46B, 46C for coupling the apertures 44, 46 of the shaft 41 to the sliding bolt 56.

Figure 6:
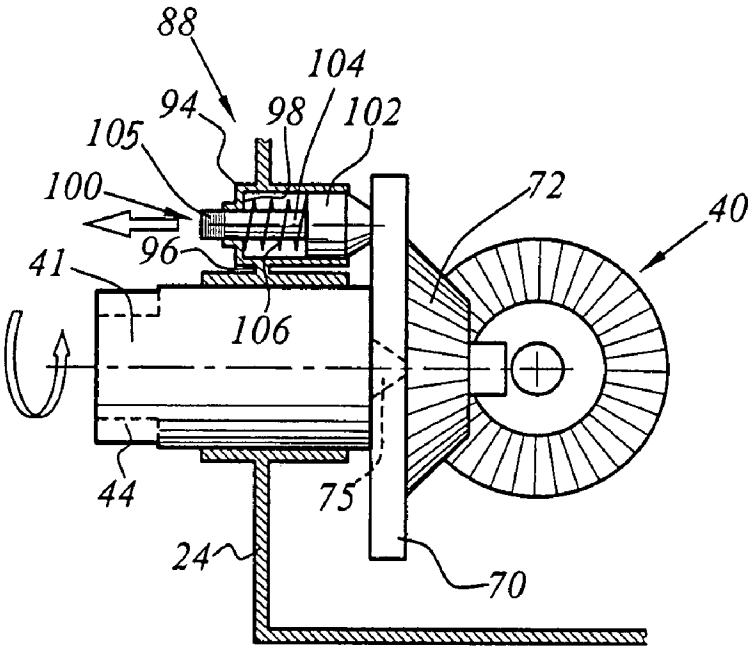
FIG. 6 is a lateral front view of the device for visualizing stable positioning of the input control shaft, placed in an intermediate position during a semi-maneuver.
Figure 5:
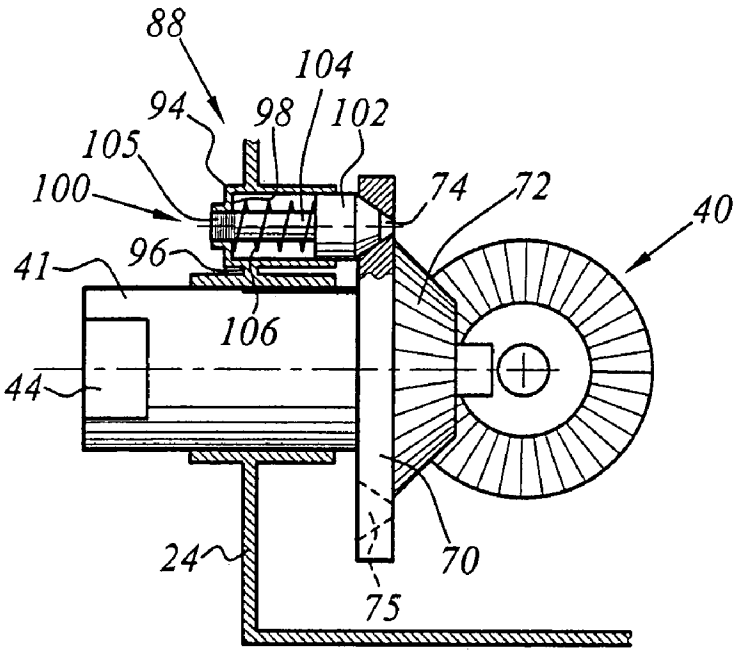
FIG. 5 is a lateral front view of the device for visualizing stable positioning of the input control shaft, placed in an end position for a semi-maneuver of the set of switch points.

FIGS. 5 and 6 illustrate a device 88 for visualizing and stabilizing the location of the position of the manual activation shaft 41. The visualization device 88 includes a shank 94 which is mounted on the wall 24 of the housing 12 and which is connected thereto by a connection member 96. The shank 94, which is generally cylindrical and which is perforated from one end to the other, includes two coaxial portions having different cross-sections with a transition zone which forms, at the inner side of the shank 94, an annular surface 98.

The device 88 for visualizing the maneuver positioning also includes a stud 100 which is formed, on the one hand, by a head 102 which is of conical form adapted to the shape of the recesses 74, 75 of the encoding plate 70 and, on the other hand, by a stud rod 104. A first end of the rod 104 is connected to the stud head 102 while the other end is provided with a visible marker 105. The visualization device 88 also includes a second stud return spring 106 fitted around the rod 104.

When assembled on the shank 94, the stud 100 provided with the second spring 106 is accommodated in the shank 94, the second spring 106 pressing on the annular surface 98.

When assembled on the encoding plate 70, the stud 100 which is urged towards the wheel 70 by the second return spring 106, comes into contact with the face, which is directed in the opposite direction, of the first pinion 72 of the angle gear 40.

FIG. 6 illustrates the visualization device 88 when the aperture 44 is rotated through 90 degrees in a clockwise direction relative to the position which it occupies in FIG. 5.

The stud 100 is in this instance pushed by the planar face of the encoding plate 70, a portion of the rod of the stud being removed from the shank 94, thus allowing the visual marker 105 to be seen by an observer outside the housing 12.

The angle of taper of the recesses 74, 75 is adjusted in order to allow the stud 100 to be readily disengaged from the recess 74, 75 under the action of a manual force on the lever 43 and a stable positioning of the stud 100 in the recess 74, 75 when the alignment is carried out and no lever force is applied.

During operation, when the sliding bolt 56 is located opposite an aperture, in this instance the aperture 44 in FIG. 1, the sliding bolt 56 engages in the aperture 44 under the action of the return spring 62.

The release of the aperture 44 is illustrated in FIG. 2 which is similar to FIG. 1. Under the permanent manual action of the operator applied to the pulling member 58 radially outwards relative to the axis 42, the sliding bolt 56 is driven completely inside the chamber 52 thereof, thereby disengaging the lever 43 from the shaft 41, allowing it to pivot freely.

During operation, when the sliding bolt 56 is engaged in the aperture 44 as illustrated in FIG. 3, the lever 43 is engaged with the control shaft 41 by a lateral zone of the sliding bolt 56 which is in contact with one of the coupling zones, in this instance the zone 44B. The circumferential force F1 applied by the operator at the end of the sleeve 50 is transmitted by the key 56 to the coupling zone 44B by a force F2 of multiplied intensity. The first return spring 62 retains the sliding bolt 56 in an engaged position in the first aperture 44.

When the sliding bolt 56 is released from the aperture 44, driven by the pulling member 58 under the permanent action of the operator, as illustrated in FIG. 4, the lever 43 can rotate freely about the control shaft 41.

When the operator has rotated the lever 43 so that the sliding bolt 56 is no longer opposite one of the apertures 44, 46, he can release the pulling member 58, the solid form of the shaft 41 being sufficiently smooth and the return force of the first spring 62 being sufficiently weak to allow the matching surface of the sliding bolt 56 to slide with little friction along the surface of the shaft 41.

When the sliding bolt 56 is again aligned with another aperture, in this instance the aperture 46, the sliding bolt 56 engages, under the action of the return force of the spring 62, with the new aperture 46.

When the stud 100 is aligned with one of the recesses 74, 75 of the encoding wheel 70, such as in this instance the recess 74 in FIG. 5, under the action of the second return spring 106, the stud 100 engages in the recess 74 and, at the same time, the visual marker 105 returns into the shank 94 and is no longer visible.

In this stabilized position of the shaft 41, the aperture 44 forms with the recess 74 an angle of 90 degrees in the clockwise direction along the pivot axis 42.

FIGS. 7 to 18 illustrate different steps of the maneuvering operation for a set of switch points in manual mode using the activation device described above.

FIGS. 7, 9, 11, 13, 15 and 17 illustrate the position of the lever 43 relative to the base 22 of the housing 12, while FIGS. 8, 10, 12, 14, 16 and 18 correspondingly illustrate the position of a switch points connection 112 which is equivalent to the position of a point considered at the movable end of the connection 112.

In FIGS. 7 to 18, the housing 12 is provided with a first stop 114 for beginning a maneuvering operation and a second stop 116 for ending a maneuvering operation.

Figure 7:
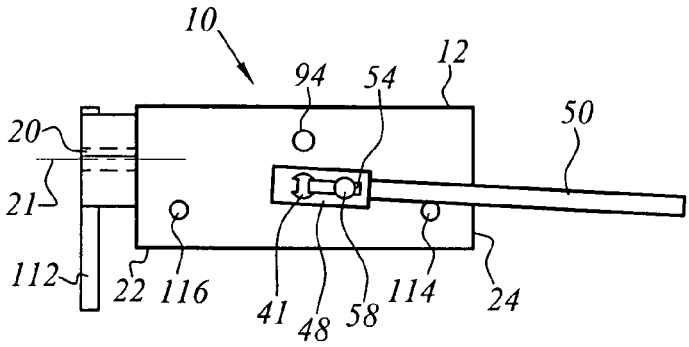
FIGS. 7 and 8 are schematic lateral views, from the front and left respectively, of the activation device in manual mode with the lever in a start position of a first maneuver.
Figure 8:
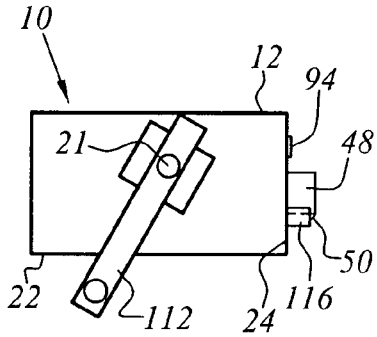

FIGS. 7 and 8 illustrate the beginning of a first semi-maneuver when the set of switch points is positioned in a position referred to as the start of a maneuvering operation.

In FIG. 7, the sleeve 50 of the lever 43 rests on the first stop 114. The visual marker 105 of the visualization device 88 has returned inside the housing 12 and is therefore not visible.

Figure 9:
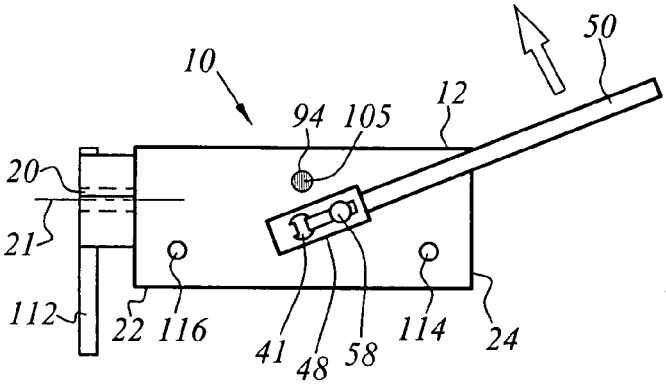
FIGS. 9 and 10 are schematic views of the activation device in manual mode similar to FIGS. 7 and 8, during the first semi-maneuver.
Figure 10:
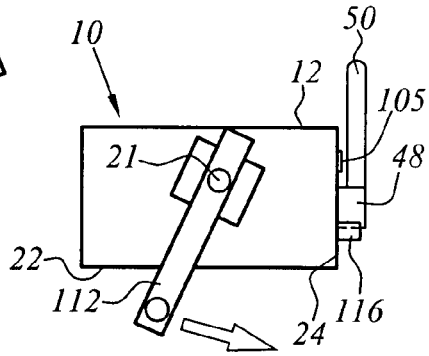

FIGS. 9 and 10 illustrate an intermediate position of the first semi-maneuver. The sleeve 50 of the lever 43 is activated in this instance towards the left-hand side in FIG. 9 and controls the movement of the output shaft 20 in the counter-clockwise direction in FIG. 10. The sliding bolt 56 is engaged in the first aperture 44. The visualization marker 105 is apparent and indicates that a stable maneuvering position has not been reached.

Figure 11:
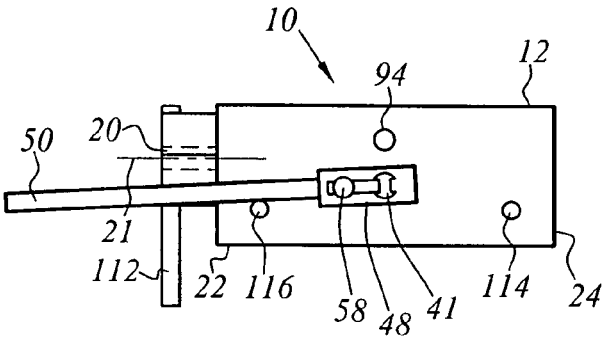
FIGS. 11 and 12 are schematic views of the activation device in manual mode similar to FIGS. 7 and 8, with the lever in an end position of the first semi-maneuver.
Figure 12:
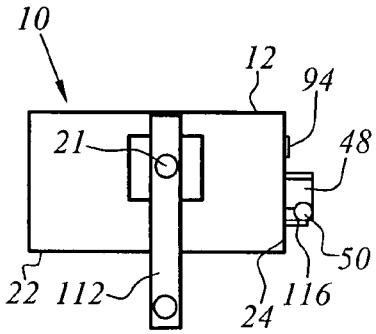

FIGS. 11 and 12 illustrate the end of the first semi-maneuver when the sleeve 50 of the lever 43 rests on the second maneuver stop 116. The visualization marker 105 has returned into the shank 94 thereof and cannot be seen from outside the housing 12. The point is located in the central maneuvering position thereof.

Figure 13:
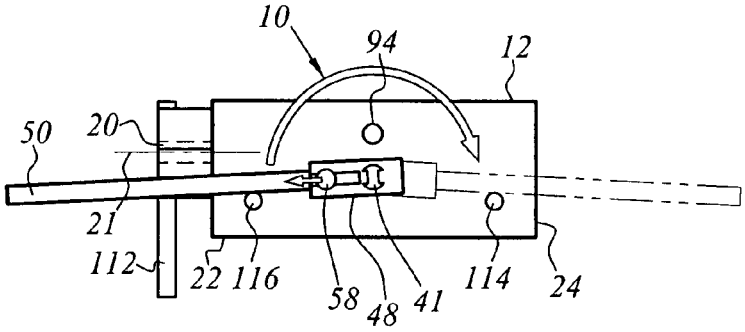
FIGS. 13 and 14 are schematic views of the activation device in manual mode similar to FIGS. 7 and 8 when the lever is returned to prepare a second semi-maneuver.
Figure 14:
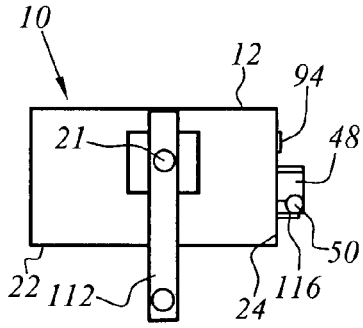

FIGS. 13 and 14 illustrate the beginning of the return of the sleeve 50 of the lever 43 in order to prepare the second semi-maneuver. The sliding bolt 56 is manually unlocked from the aperture 44 in order to be able to allow the lever 43 to return to the rear, illustrated in this instance towards the right in a clockwise direction. Since the sleeve 50 of the lever 43 is then moved back into abutment against the first stop 114, the sliding bolt 56 engages with the second aperture 46 under the action of the spring.

Figure 15:
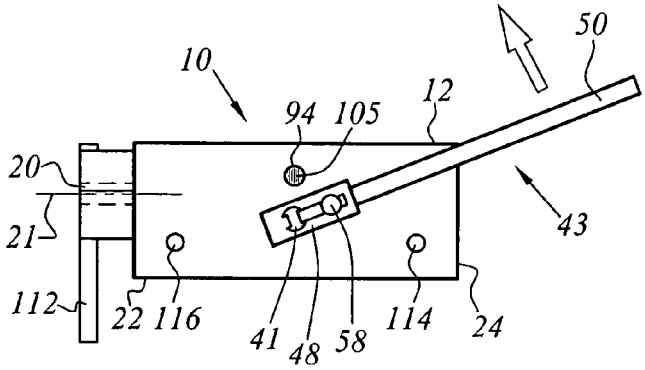
FIGS. 15 and 16 are schematic views of the activation device in manual mode similar to FIGS. 7 and 8 during the second semi-maneuver.
Figure 16:
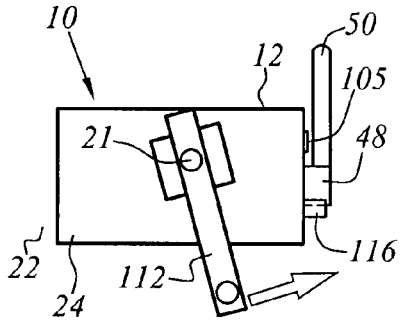

FIGS. 15 and 16 illustrate an intermediate configuration during the second semi-maneuver. The sleeve 50 of the lever 43 is activated again in the counter-clockwise direction in FIG. 15 and the visual marker 105 can be seen at the outer side of the housing 12. The point is then moved over the second portion of its maneuver path, that is to say, towards the right in FIG. 16.

Figure 17:
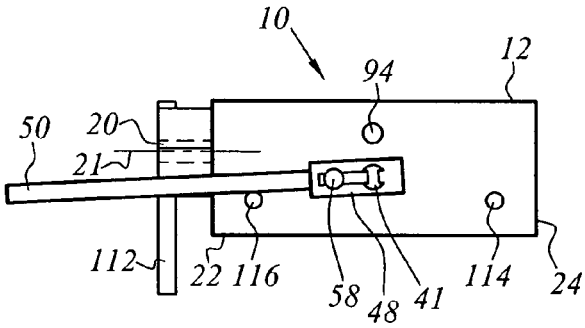
FIGS. 17 and 18 are schematic views of the activation device in manual mode similar to FIGS. 7 and 8 with the lever in an end position of the second semi-maneuver.
Figure 18:
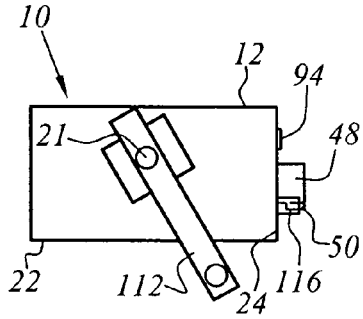

When the second semi-maneuver is complete, as illustrated in FIGS. 17 and 18, the sleeve 50 of the lever 43 rests on the second maneuver stop 116 while the visual marker 105 can no longer be seen and indicates the end of the switch points maneuver, the point having completed its movement to the end of the path.

In this instance, the two paths, a first return movement followed by a second one-way movement of the lever 43 are carried out during the first and the second semi-maneuver, respectively, that is to say, the entire maneuver constitutes a movement path of the lever 43.

A common portion is defined as the common spatial path of the engaged lever, in this instance, moving by a semi-maneuver, a first portion being defined as the initial movement of the lever during the first semi-maneuver and a second portion being defined as the initial movement of the lever 43 during the second semi-maneuver.

The second portion follows the first portion in the sequential direction of the portion and the output shaft 20 is driven in the same direction when passing through successive portions.

In a variant, a movement path may be a return movement of the lever 43, where the output shaft 20 is driven in one direction during the initial movement of the lever 43 and is driven in the same direction during the return movement which immediately follows the initial movement.

In this instance, there is a mechanism for inverting the drive movement direction of the lever 43 arranged between the lever 43 and the output shaft 20. A path portion common to the initial and return directions may be defined as constituting a common portion.

A first portion is the common portion traveled in the initial direction while a second portion which follows the first is the common portion traveled in the return direction.

What is claimed is:

1. A device for manually maneuvering a set of rail switch points intended to apply a force at a location of the set of switch points in order to switch the set of switch points from a first position to a second position, the device comprising:

a housing;

a guided member for controlling the set of switch points, the guided member being movable with respect to the housing;

a guiding member movable with respect to the housing; and a transmission mechanism for transmitting force from the guiding member to the guided member;

the guiding member being moved along at least two displacement paths having a common portion for driving the guided member, the guided member being driven on each displacement path of the guiding member in a same rotational direction along successive portions of a movement path of the guided member, wherein the guiding member is a lever articulated to the housing, and the transmission mechanism includes an input shaft connected to the guided member and actuatable by the lever, and a connection member capable of coupling or uncoupling the lever to or from the input shaft.

2. The device for manually maneuvering the set of switch points as recited in claim 1 wherein the transmission mechanism is arranged so the guiding member is movable in a first direction in order to drive the guided member in one direction and is movable in a second direction, opposed to the first direction, while the guided member remains fixed relative to the housing.

3. The device for manually maneuvering the set of switch points as recited in claim 1 wherein the transmission mechanism includes a movable connection member allowing releasable coupling by matching the shape of the guiding member to the guided member.

4. The device for manually maneuvering the set of switch points as recited in claim 3 wherein the connection member is a key or an engagement tooth.

5. The device for manually maneuvering the set of switch points as recited in claim 1 wherein the input shaft includes at least two longitudinal and circumferential apertures distributed angularly in a uniform manner at one end, and the connection member includes a sliding bolt accommodated in the lever and a return spring capable of projecting a zone of the sliding bolt outside the lever towards the input shaft, the sliding bolt being movable between a disengaged position and an engaged position, the disengaged position occurring when the sliding bolt and the apertures are offset at the circumference and the lever is capable of pivoting freely about the input shaft, the engaged position occurring when the sliding bolt is engaged in an aperture and retained therein under an action of the return spring and the lever is locked and fixedly joined to the input shaft.

6. The device for manually maneuvering the set of switch points as recited in claim 5 wherein the sliding bolt includes a pulling member which forms a gripping member for manual activation and protrudes with respect to the lever, allowing the sliding bolt to be moved outside the apertures.

7. The device for manually maneuvering the set of switch points as recited in claim 1 wherein the transmission mechanism includes a step-down gear and the transmission ratio is less than 1.

8. The device for manually maneuvering the set of switch points as recited in claim 1 wherein a length of the lever arm is less than 1 meter.

9. The device for manually maneuvering the set of switch points as recited in claim 1 wherein the transmission mechanism includes an angle gear device.

10. The device for manually maneuvering the set of switch points as recited in claim 1 further comprising a device for visualizing a position of the input shaft or correspondingly the set of switch points.

11. The device for manually maneuvering the set of switch points as recited in claim 10 wherein the input shaft includes a position encoding plate fixedly joined to and co-axial with the input shaft, perforated by at least two holes which are positioned with circumferential distribution, and wherein the visualization device includes a sheath, a signaling sensor including a rod, the rod having at one end a head capable of sliding in the sheath and having a shape matching the holes, the rod carrying, at a second free end, a visual marker, and a spring for urging the rod of the signaling sensor towards the plate, the spring being pretensioned in the sheath and pressing on the head to hold the head in contact with a face of the encoding plate when the head is angularly offset from all the holes, the visual marker then leaving the hole of the sheath.

12. Track equipment comprising a set of switch points and a maneuvering device as recited in claim 1 for controlling the set of switch points.

* * * * *